US005286173A

United States Patent [19]

Takenaka et al.

[11] Patent Number: 5,286,173

[45] Date of Patent: Feb. 15, 1994

[54] COOLANT GAS GUIDING MECHANISM IN SWASH PLATE TYPE COMPRESSOR

[75] Inventors: Kenji Takenaka; Toru Takeichi; Hiroaki Kayukawa; Shigeyuki Hidaka, all of Kariya, Japan

[73] Assignee: Kabushiki Kaisha Toyoda Jidoshokki Seisakusho, Kariya, Japan

[21] Appl. No.: 963,850

[22] Filed: Oct. 20, 1992

[30] Foreign Application Priority Data

Oct. 23, 1991 [JP] Japan ..... 3-275721
Oct. 30, 1991 [JP] Japan ..... 3-285201

[51] Int. Cl.[5] ..... F04B 1/12

[52] U.S. Cl. ..... 417/269; 417/500

[58] Field of Search ..... 417/269, 222.1, 500; 137/625.11, 624.13

[56] References Cited

U.S. PATENT DOCUMENTS

| | | | |
|---|---|---|---|
| 2,663,492 | 12/1953 | Eaton | 417/222.1 |
| 3,304,886 | 2/1967 | Roberts | 417/222.1 |
| 3,498,227 | 3/1970 | Kita | 417/269 |
| 3,817,660 | 6/1974 | Knowles | 417/269 |
| 4,007,663 | 2/1977 | Nagatomo et al. | 417/269 |
| 4,174,191 | 11/1979 | Roberts | 417/269 |
| 4,226,572 | 10/1980 | Nakayama et al. | 417/269 |
| 4,347,778 | 9/1982 | Murray | 417/269 |
| 4,880,360 | 11/1989 | Terauchi | 417/269 |
| 5,178,521 | 1/1993 | Ikeda | 417/269 |
| 5,181,834 | 1/1993 | Ikeda | 417/269 |

*Primary Examiner*—Richard A. Bertsch
*Assistant Examiner*—Peter Koryinyk
*Attorney, Agent, or Firm*—Brooks Haidt Haffner & Delahunty

[57] ABSTRACT

The housing of a swash plate type compressor includes a suction chamber and a discharge chamber. A plurality of cylinder bores are formed in a cylinder block connected to the housing. A plurality of pistons in corresponding cylinder bores are provided such that each piston reciprocates as a function of the rotation of a rotary shaft. A valve chamber communicates with at least one of the suction chamber and discharge chamber, and is provided between the housing and the cylinder block. The valve chamber is connected to the cylinder bores via respective passages. A rotary valve is accommodated rotatably in the valve chamber. A guide groove is provided in the outer surface of the rotary valve to permit communication between each cylinder bore and the associated passage in at least one of a suction stage and a compression stage of the coolant gas. A gas passage has one of its ends connected to the guide groove, and the other end connected to either the suction chamber or discharge chamber and is provided in the rotary valve. The rotary valve is coupled to the rotary shaft by a connecting member.

17 Claims, 11 Drawing Sheets

COOLANT GAS GUIDING MECHANISM IN SWASH PLATE TYPE COMPRESSOR

BACKGROUND OF THE INVENTION

This application claims the priority of Japanese Patent Application No. 3-275721 filed Oct. 23 and Japanese Patent Application No. 3-285201 filed Oct. 30, 1991, both of which are incorporated herein by reference.

Field of the Invention

The present invention relates to a coolant gas guiding mechanism in a swash plate type compressor.

Description of the Related Art

A conventional swash plate type compressor has a housing 52 with a suction chamber 50 and a discharge chamber 51, as shown in FIG. 17. Cylinder bores 53 are formed in a cylinder block 54. A valve plate 55 has a suction port 55*a* and a discharge port 55*b* formed therein. A suction plate 56 and a discharge plate 57 have a suction valve 56*a* and a discharge valve 57*a*, respectively. The valve plate 55 is disposed between the cylinder block 54 and the housing 52. The suction plate 56 and the discharge plate 57 are located on corresponding sides of the valve plate 55.

When a piston 58 moves leftward, as illustrated in FIG. 17, the suction valve 56*a* is elastically deformed to open the suction port 55*a*, in order to allow the coolant gas in the suction chamber 50 to be sucked in, via the suction port 55*a*, into a working chamber 59 in the associated cylinder bore 53. When the piston 58 shifts rightward after the suction operation is completed, the suction valve 56*a* closes the suction port 55*a*. Thereafter, when the pressure in the working chamber 59 rises to, or above a predetermined level, the discharge valve 57*a* elastically deforms to open the discharge port 55*b*, in order to discharge the compressed coolant gas from the working chamber 59 into the discharge chamber 51, via the discharge port 55*b*.

In general, a lubricant oil is mixed with the coolant gas, which will stick on the suction valve 56*a*, etc. Consequently, when the suction valve 56*a* elastically deforms to open the suction port 55*a*, the oil might cause the suction valve 56*a* to adhere to the suction port 55*a*, thus adversely affecting the suction response.

The suction valve is designed to open the suction port against the elasticity of the valve in accordance with a change in the suction pressure of the coolant gas. This design requires that the pressure of the coolant gas be raised above the elastic force of the suction valve, thus resulting in an increase of the pressure loss in the compressor. In addition, when the suction valve closes the suction port particularly in a high-load operation, the suction valve might hit against the valve plate, generating noise and damaging the valve.

SUMMARY OF THE INVENTION

Accordingly, the present invention has been accomplished with a view to overcoming the above-described problems, and it is an object of the present invention to provide a coolant gas guiding mechanism in a swash plate type compressor, which can suppress the pressure loss and the generation of noise, and can prevent this valve from being damaged.

To achieve the above object, the compressor housing according to the present invention has a suction chamber and a discharge chamber. A plurality of cylinder bores are formed in a cylinder block connected to the housing. Pistons are provided in respective cylinder bores such that each piston reciprocates, via a swash plate, in relation to the rotation of a rotary shaft. A valve chamber, which communicates with at least one of the suction chamber and discharge chamber, is provided between the housing and the cylinder bores via corresponding passages. A rotary valve is rotatably accommodated in the valve chamber. A gas guide groove is provided in the outer surface of the rotary valve to permit communication between each cylinder bore and the associated passage, during at least, the suction stage and the compression stage of the coolant gas. A gas passage has one of its ends connected to the guide groove, and its other end connected to either the suction chamber or the discharge chamber. The passage is provided in the rotary valve that is drivably coupled to the rotary shaft.

BRIEF DESCRIPTION OF THE DRAWINGS

The invention, together with the objects and advantages thereof, may best be understood by reference to the following description of the presently preferred embodiments, together with the accompanying drawings in which.

DETAILED DESCRIPTION OF THE PREFERRED EMBODIMENTS

A first embodiment of the present invention as applied to a rocking swash plate type compressor will now be described with reference to FIGS. 1 through 4.

Figure 1:
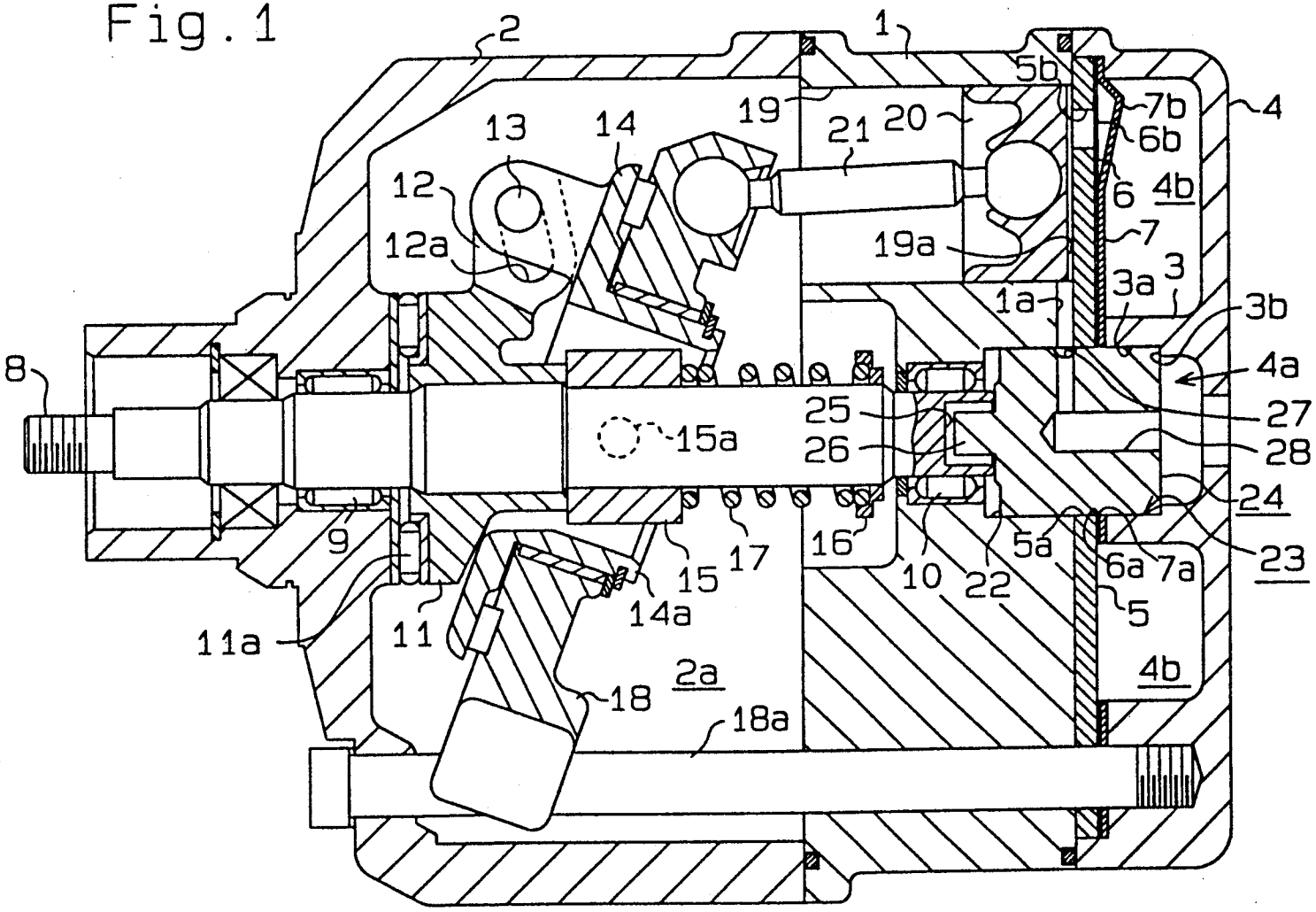
FIG. 1 is a cross sectional view of a swash plate type compressor according to a first embodiment of the present invention.

As shown in FIG. 1, a front housing 2 is connected to the front side of a cylinder block 1, and include a crank chamber 2a. A rear housing 4 is securely connected via a valve plate 5 to the rear side of the cylinder block 1. A suction chamber 4a and a discharge chamber 4b are defined by a partition 3 in the rear housing 4. A discharge plate 6 and a retainer plate 7 are disposed between the valve plate 5 and rear housing 4. A rotary shaft 8 is rotatably supported between the cylinder block 1 and the front housing 2 by radial bearings 9 and 10.

A drive plate 11 is fixed to the rotary shaft 8 in the front housing 2, with a thrust bearing 11a disposed between the front end of the drive plate 11 and the inner wall of the front housing 2. The thrust bearing 11a receives a compressive reaction force when a coolant gas is compressed.

A support arm 12 is protrusively formed on the outer surface of the drive plate 11. A slider 15 is fitted over the rotary shaft 8 to be slidable in the axial direction. A spring sheet 16 is secured to the rotary shaft 8, with a spring 17 disposed between the spring sheet 16 and the slider 15. The slider 15 is urged toward the drive plate 11 by the urging force of the spring 17.

A pair of pins 15a (only one is shown) protrude perpendicularly to the rotary shaft 8, and are attached to the slider 15. A rotary plate 14 is supported at its support portion 14a to the pins 15a, so as to be swingable along the axis of the rotary shaft 8. An elongated hole 12a is formed in the free end of the support arm 12, and a pin 13 is fitted slidably in the hole 12a. The rotary plate 14 is coupled tiltably to the drive plate 11, via this pin 13. A swash plate 18 is mounted at the support portion 14a of the rotary plate 14, in order to be rotatable relative to the support portion 14a, while a pin 18a, which extends parallel to the rotary shaft 8, is attached to the cylinder block 1 and the housings 2 and 4. The swash plate 18 is swingable along a pin 18a and its revolution is restricted thereby.

A plurality of cylinder bores 19 are formed in the cylinder block 1 equidistally from the rotary shaft 8, in parallel thereto. Each cylinder bore 19 communicates with the crank chamber 2a. A piston 20 is fitted reciprocatably in each cylinder bore 19, with a working chamber 19a defined between the piston 20 and the valve plate 5. Each piston 20 is coupled to the swash plate 18 by a piston rod 21. The rotational motion of the rotary shaft 8 is thus converted to a back-and-forth swing motion of the swash plate 18, via the drive plate 11 and rotary plate 14. Accordingly, each piston 20 moves forward and backward in the associated cylinder bore 19 to execute suction, compression and discharge of the coolant gas.

A central opening 22, having a circular cross section corresponding to the rotary shaft 8, is formed in the center portion of the cylinder block 1. Central openings 5a, 6a and 7a have similar inner diameters to the central opening 22, and are formed in the valve plate 5, discharge plate 6 and retainer plate 7, respectively. A central opening 3a, which communicates with the central openings 22, 5a, 6a and 7a and a step 3b, are formed in the partition 3 on the side of the suction chamber 4a in the rear housing 4. The central openings 22, 5a, 6a, 7a and 3a and the step 3b form a valve chamber 23 which accommodates a rotary valve 24. The rotary valve 24 is caused to rotate by the rotary shaft 8.

Figure 4:
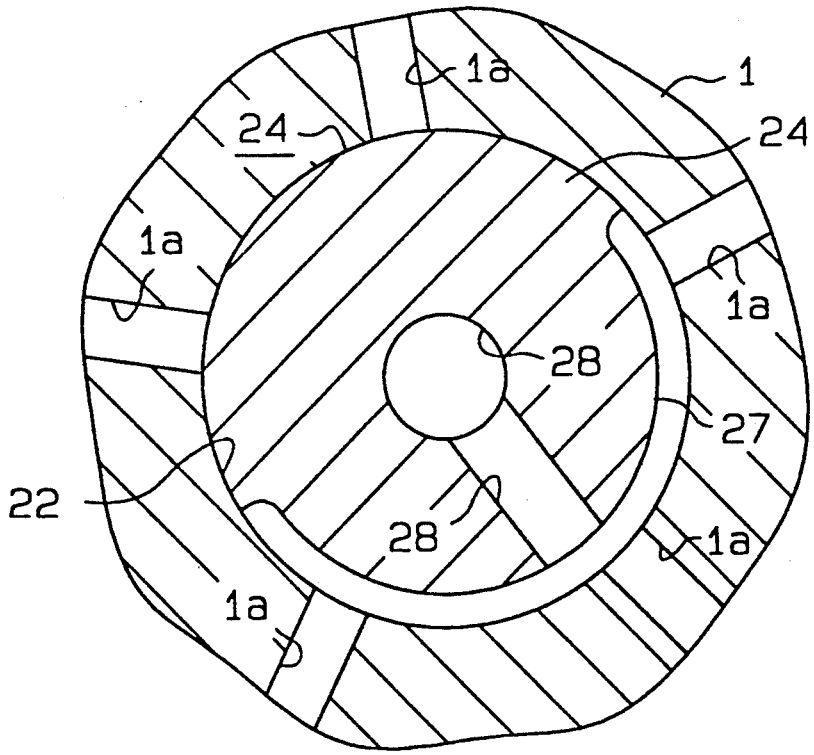
FIG. 4 is a partly enlarged lateral cross sectional view of the rotary valve of FIG. 2.

FIGS. 1 and 4 illustrate a plurality of suction passages 1a which extend radially from the central opening 22, and which are formed in the rear side of the cylinder block 1. The suction passages 1a permit the central opening 22 to communicate with the working chambers 19a. Discharge ports 5b are formed in the valve plate 5 in association with the respective working chambers 19a. The individual discharge ports 5b are opened and closed by respective discharge valves 6b of the discharge plate 6. The open position of each discharge valve 6b is restricted by a retainer 7b of the retainer plate 7.

Figure 2:
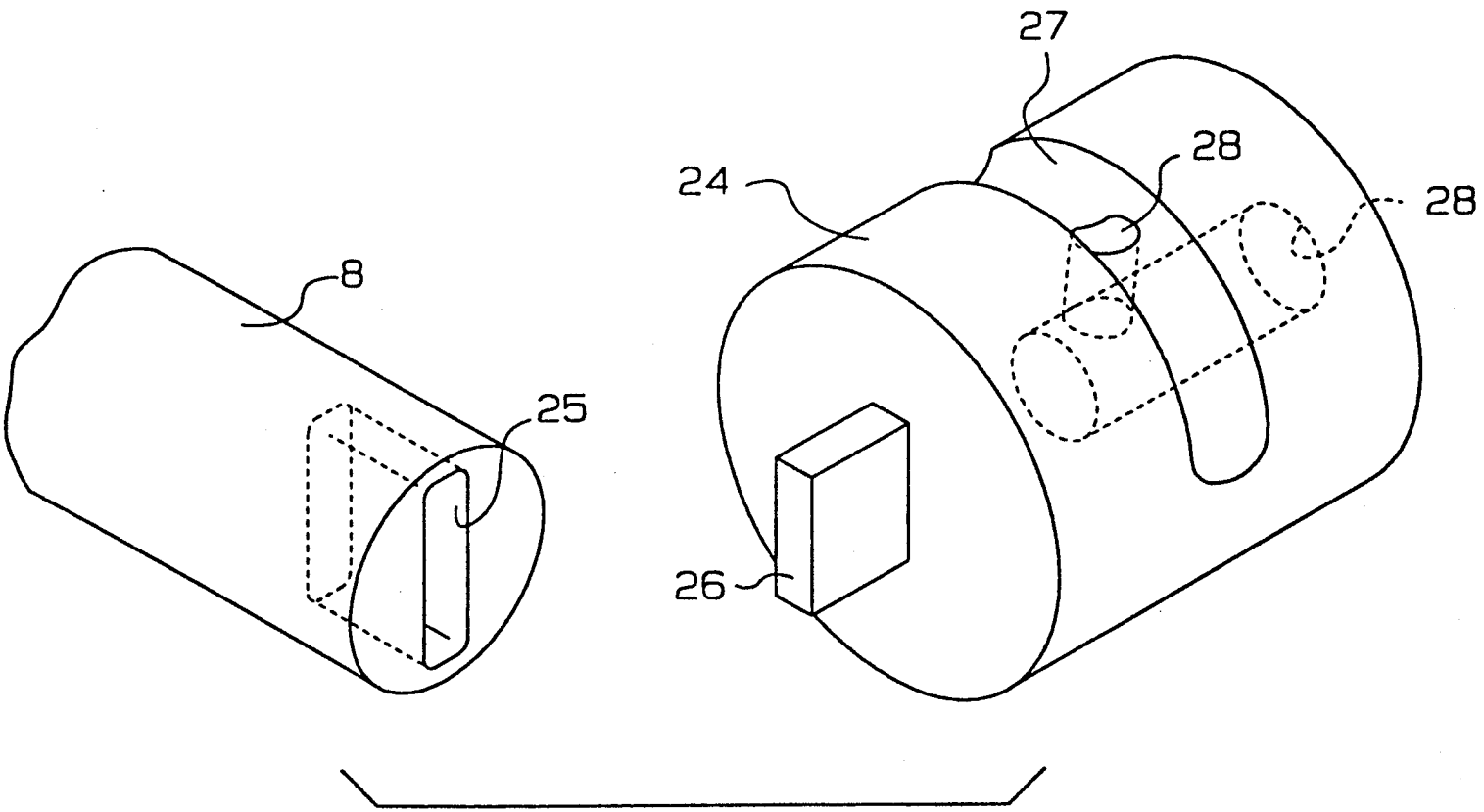
FIG. 2 is a partly exploded perspective view showing a rotary shaft and a rotary valve for use in the compressor of FIG. 1.
Figure 3:
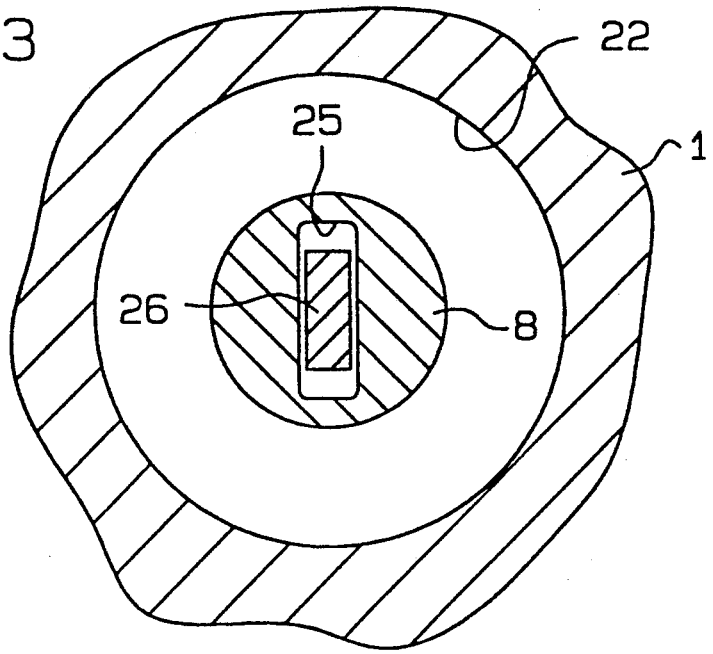
FIG. 3 is a lateral cross sectional view illustrating the interconnection between the rotary shaft and the rotary valve of FIG. 2.

As shown in FIG. 2, the rotary valve 24 has a generally cylindrical form. A connecting hole 25 having a generally rectangular cross section is formed in the rear end of the rotary shaft 8 in association with the front end of the rotary valve 24. A connecting protrusion or stud 26 has a generally rectangular cross section extends integrally from the front end of the rotary valve 24. The length and width of the stud 26 are shorter than those of the connecting hole 25; that is, the stud 26 has a smaller cross-sectional area than the connecting hole 25. Accordingly, when the stud 26 and the hole 25 are engaged, the stud 26 loosely fit within the hole 25. Clearances in the range of 1 to 2 mm and 0.2 mm are formed between the stud 26 and the hole 25.

As shown in FIGS. 2 and 4, a guide groove 27 is formed along the outer peripheral surface of the rotary valve 24. The guide groove 27 has a length of about one half of the outer perimeter of the rotary valve 24. A suction passage 28 is generally L shaped, and is formed in the rotary valve 24 to allow the guide groove 27 to communicate with the suction chamber 4a in the rear housing 4.

The operation of the present compressor will now be described in detail. FIG. 1 shows one piston 20 positioned at its upper dead point. When the coolant gas is sucked into the working chamber 19a in this condition, the swash plate 18 swings as the rotary shaft 8 rotates, and causes the piston 20 to move leftward from the upper dead point. The suction chamber 4a communicates with the working chamber 19a via the suction passage 28, the guide groove 27, and the suction passage 1a. As a result, the coolant gas in the suction chamber 4a is sucked into the working chamber 19a.

Since the guide groove 27 has a length of about one half of the outer perimeter of the rotary valve 24, the groove 27 sequentially communicates with all the suction passages 1a during the suction stage or when the rotary shaft rotates by one half turn. When the compression stage starts thereafter, the outer surface of the rotary valve 24 sequentially blocks the inlets of all the suction passages 1a. This shuts off the communication between the suction chamber 4a and each working chamber 19a. When the pressure in the working chamber 19a reaches, or exceeds a predetermined level, the coolant gas is discharged into the discharge chamber 4b from the associated discharge port 5b of the valve plate 5.

According to the first embodiment, the suction and blocking of the gas are performed by the rotary valve 24, as described above. This design embodiment can therefore improve the valve response to the pressure of the sucked gas, as compared with the conventional compressor which uses a suction valve having a thin plate shape.

According to the present embodiment, the connecting hole 25 is formed in the rear end of the rotary shaft 8 and the stud 26 is loosely fitted therein, and is formed on the front end of the rotary valve 24. It is thus unnecessary to couple or connect the rotary shaft 8 to the rotary valve 24 with high precision and to account for the eccentricity of the rotary valve 24 with respect to the rotary shaft 8, once they are assembled.

Even if the rotary shaft 8 and the rotary valve 24 are assembled with some eccentricity due to manufacture error or tolerance between the inner wall of the radial bearing 10 and the central opening 22, this eccentricity would be compensated by the clearance between the connecting hole 25 and connecting protrusion 26. Accordingly, the rotary shaft 8 and the rotary valve 24 will rotate smoothly; will minimize the wear of the contact surfaces between the rotary valve 24 and the valve chamber 23; and will provide an efficient sealing.

A few exemplary modifications to the first embodiment will now be described.

Figure 5:
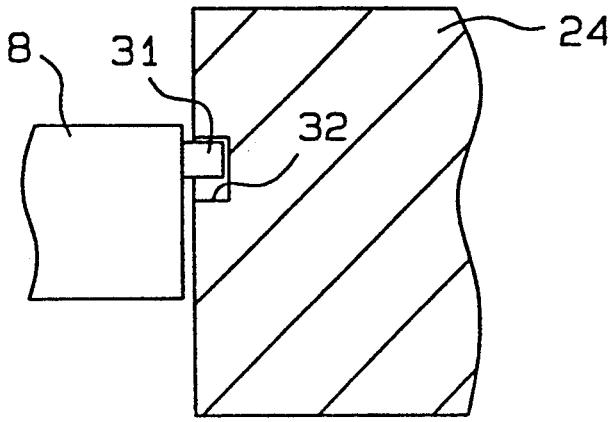
FIGS. 5 through 8 are partial cross sectional views illustrating modifications of the first embodiment.

In a first modification shown in FIG. 5, a connecting protrusion 31 is formed in the rear end of the rotary shaft 8, and is offset from the center thereof. The protrusion 31 is loosely fitted within a connecting hole 32 formed in the end face of the rotary valve 24. The rotational motion of the rotary shaft 8 is therefore transmitted to the rotary valve 24.

Figure 6:
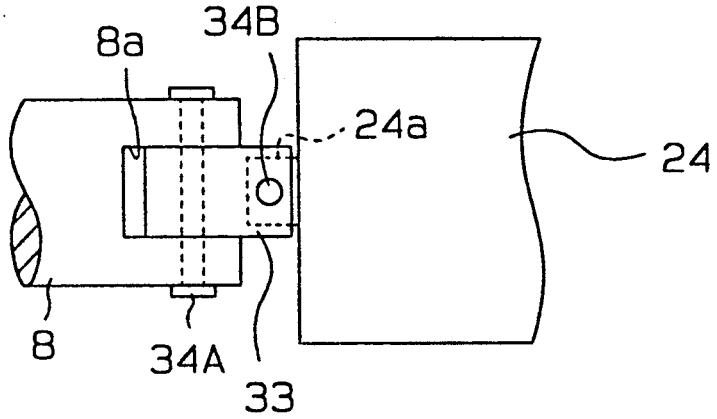

In a second modification shown in FIG. 6, a recess **8*a* is formed in the distal end of the rotary shaft 8, and one end of a connecting member 33 is rotatably engaged with the recess by a pin 34A. The other end of the connecting member 33 is rotatably coupled to a boss 24*a* of the rotary valve 24 by a pin 34B. The pins 34A and 34B generally extend perpendicularly to each other. Therefore, the rotary valve 24 can rotate in a plane which includes the axis of the rotary shaft 8 and in a plane perpendicular to the former plane. Even if the rotary shaft 8 and the rotary valve 24 are assembled with some eccentricity, such eccentricity would be compensated by the pins 34A and 34**B.

Figure 7:
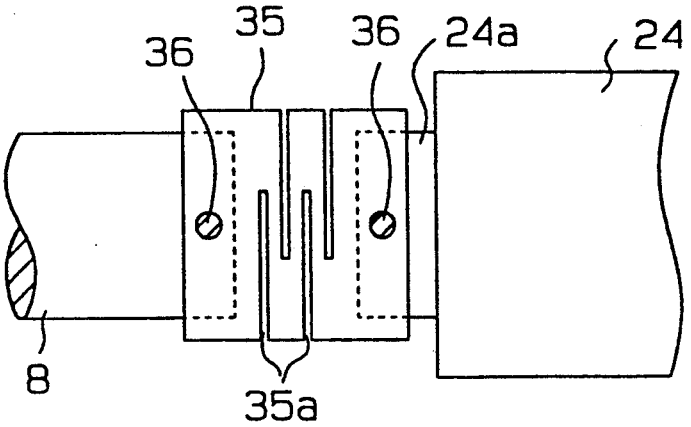

In a third modification shown in FIG. 7, an elastic coupling 35 having a slit **35*a* is provided between the distal end of the rotary shaft 8 and the boss 24*a* of the rotary valve 24, so that the rotary shaft 8 and the rotary valve 24 are coupled together by the elastic coupling 35 and a pair of screws 36**. This modification presents similar advantages to the second modification above.

Figure 8:
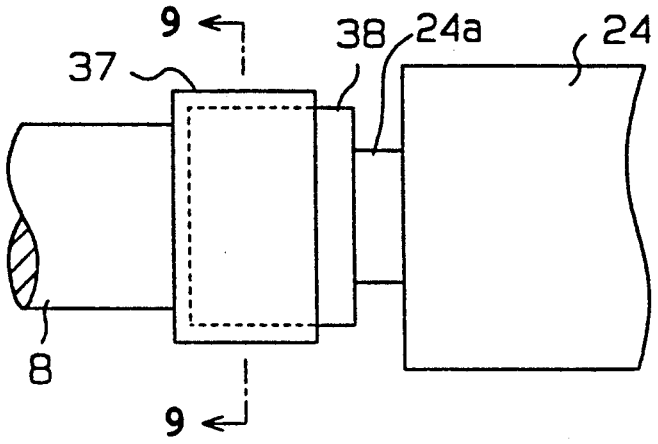
Figure 9:
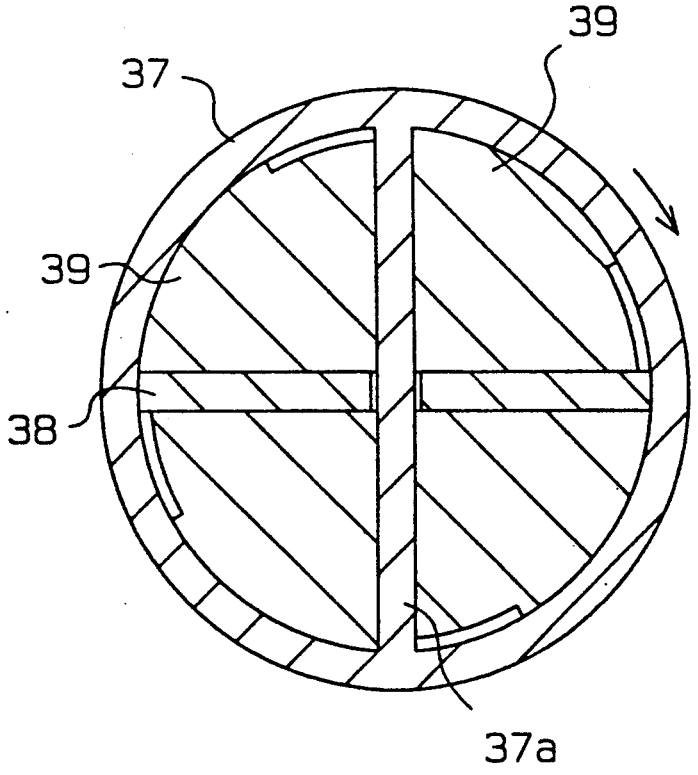
FIG. 9 is an enlarged cross sectional view taken along line A—A in FIG. 8.

In a forth modification shown in FIGS. 8 and 9, a drive sleeve 37 has a drive plate **37*a*, and is fitted on the rotary shaft 8. A driven plate 38 is attached to the boss 24*a* of the rotary valve 24, and is loosely fitted on the drive plate 37*a*. The space between the drive plate 37*a* and the driven plate 38 is filled with an elastic material 39 made of urethane resin or like material. When the drive sleeve 37 is caused to rotate by the rotary shaft 8, this rotational motion is transmitted to the rotary valve 24 via the drive plate 37*a*, elastic material 39 and driven plate 38. Even if the rotary shaft 8 and the rotary valve 24 are assembled with some eccentricity, the present embodiment allows the eccentricity to be compensated by the elastic material 39**.

Figure 10:
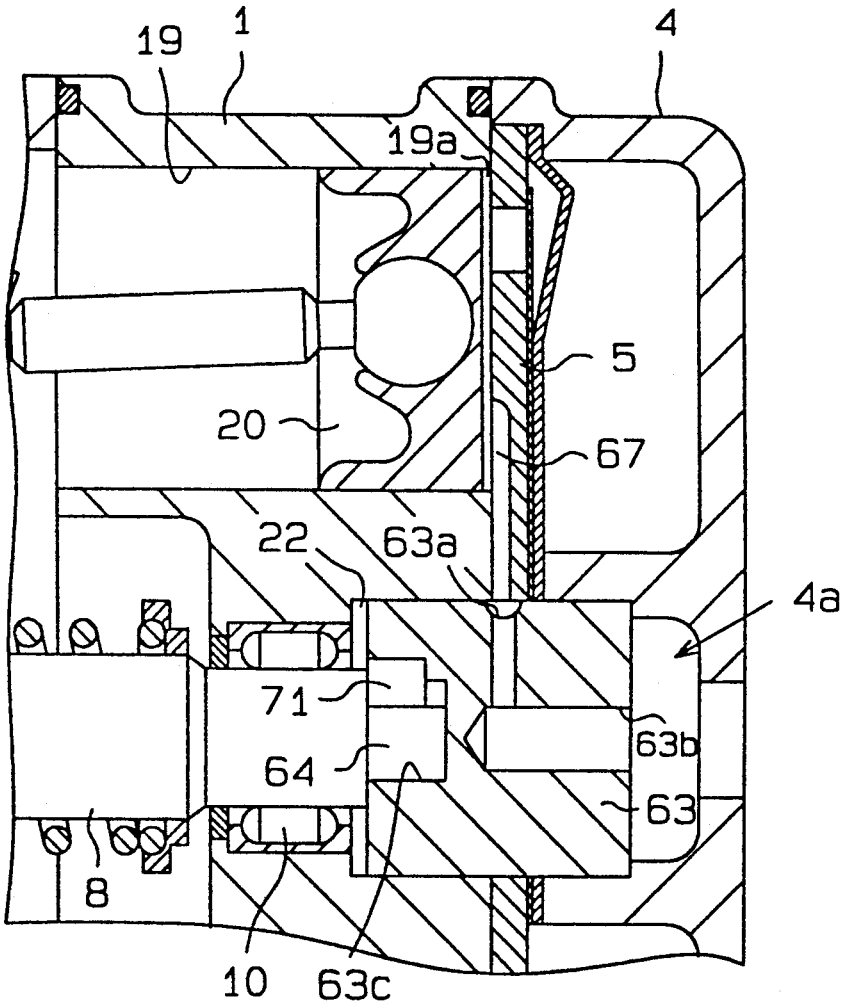
FIG. 10 is a partial cross sectional view showing a rotary valve of a compressor according to yet another modification of the first embodiment.

In a fifth modification shown in FIG. 10, a rotary valve 63 has a guide groove **63*a* and a suction passage 63*b*, which are designed in the same way as those of the first embodiment. A guide groove 67 permits communication between the guide groove 63*a* and the working chambers 19*a*, and is formed in the valve plate 5. A generally cylindrical connecting protrusion 64 is formed on the rear end of the rotary shaft 8. A connecting hole 63*c* having a circular cross section is formed in the front end of the rotary valve 63. As the connecting protrusion 64 is pushed into the connecting hole 63*c*, the rotary shaft 8 and the rotary valve 63 are engaged. The latter are integrally rotatable with each other by means of a key 71, with the axial center of the rotary shaft 8 matching that of the rotary valve 63. This modification has similar advantages to those of the first embodiment. Since the rotary shaft 8 is fixed to the rotary valve 63, it is necessary to improve the working precision for both elements and the members that support them to prevent the eccentric rotation of the rotary valve 63, when the rotary shaft 8 and the rotary valve 63** rotate together.

The second embodiment of the present invention will now be described with reference to FIGS. 11 to 13, focusing mainly on the differences between the first and second embodiments.

Figure 11:
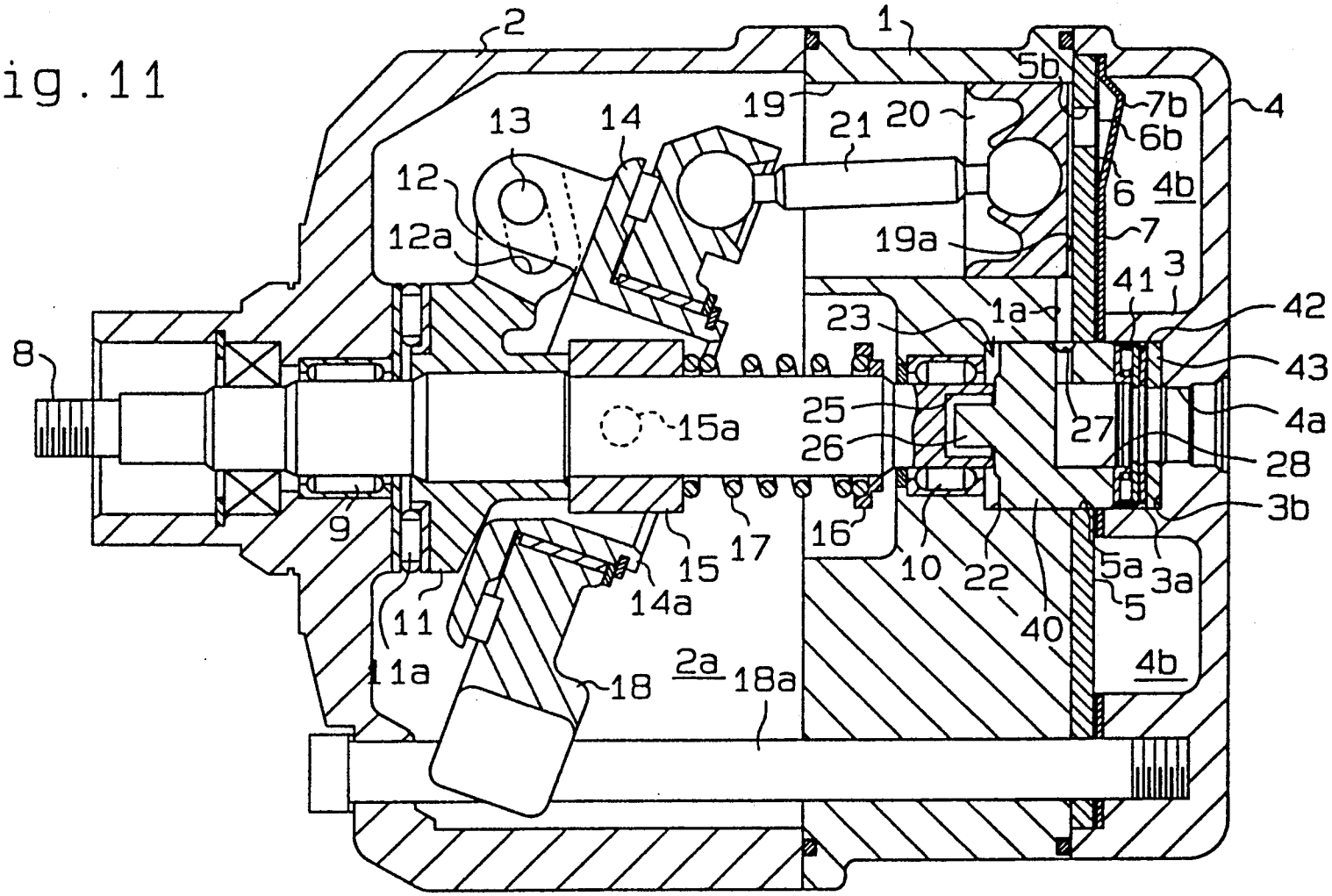
FIG. 11 is a cross sectional view of a swash plate type compressor according to a second embodiment of the present invention.
Figure 12:
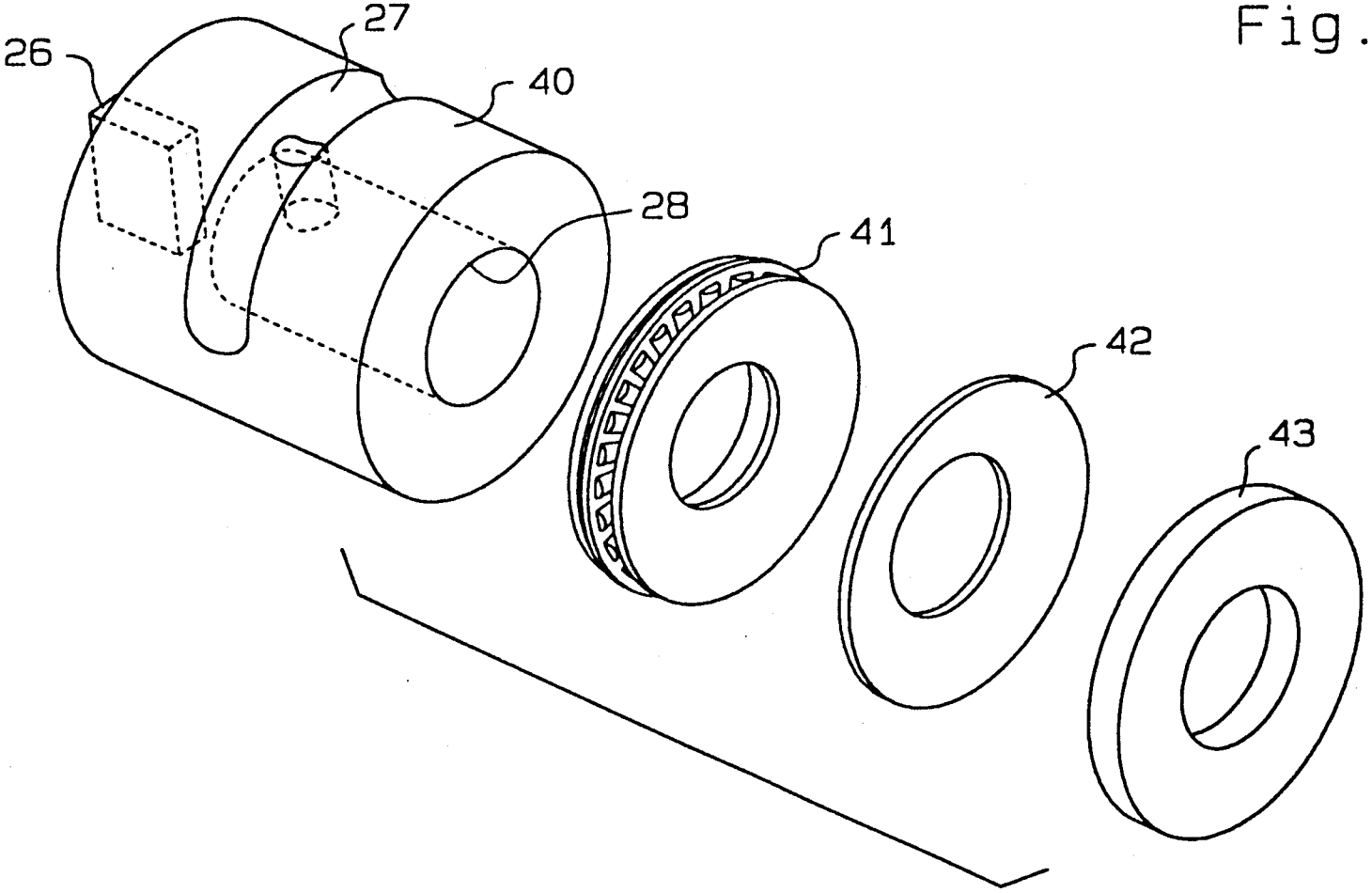
FIG. 12 presents an exploded perspective view showing a rotary valve, a thrust bearing, a disc spring and a spacer for use in the compressor of FIG. 11.
Figure 13:
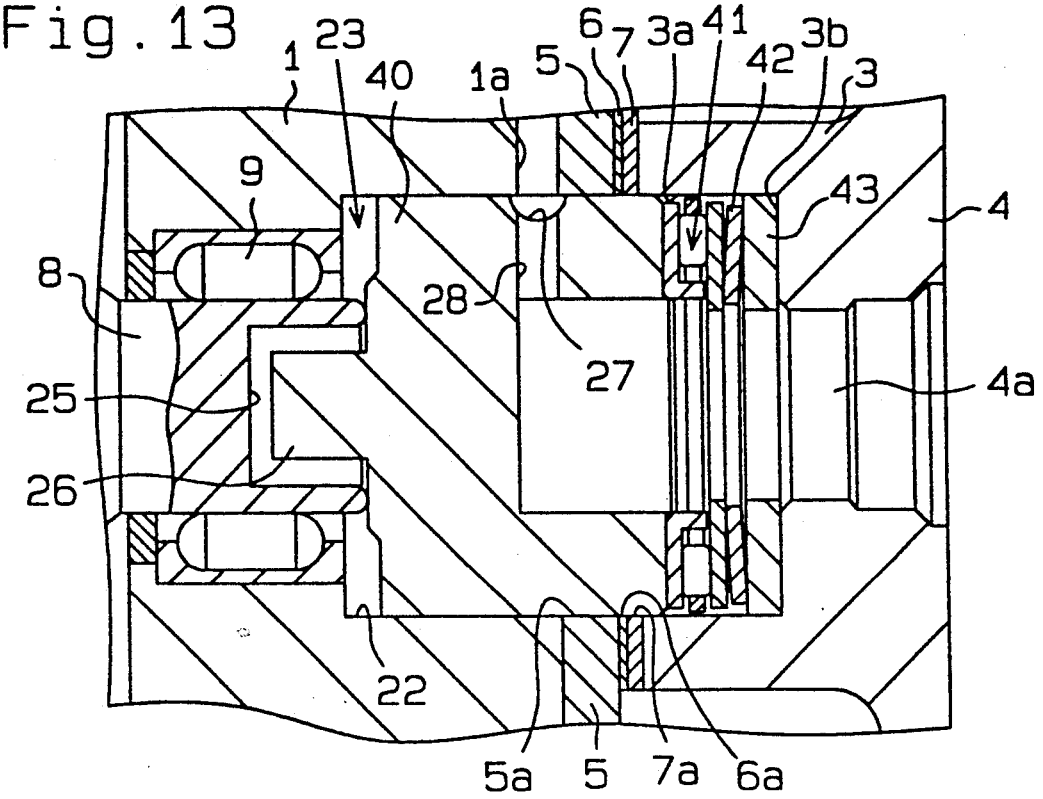
FIG. 13 is a partly enlarged lateral cross sectional view of the rotary valve in the compressor of FIG. 11.

As shown in FIGS. 11 and 13, a rotary valve 40 of the second embodiment has the same guide groove 27 and suction passage 28 as provided in the first embodiment. A thrust bearing 41, a disc spring 42 and a spacer 43 for adjusting the urging force of the spring 42, are sequentially disposed in the above order, between the flat rear end of the rotary valve 40 and the step **3*b* of the partition 3. Such of these three elements 41 to 43 has a ring shape, as shown in FIG. 12. The outer peripheral portion of the disc spring 42 is located closer to the rear of the compressor than the inner peripheral portion. The inner peripheral portion abuts on the thrust bearing 41 while the outer peripheral portion abuts on the spacer 43. The urging force of the disc spring 42 presses the thrust bearing 41 against the rotary valve 40, thus pressing the rotary valve 40 against the rear end of the rotary shaft 8. The spring force is transmitted, via the rotary shaft 8 to the drive plate 11, so that the drive plate 11 is pushed against the thrust bearing 10** by the proper pressure.

This embodiment exhibits a similar performance and advantages to those of the first embodiment. Further, because the thrust load to the rotary valve 40 is received by the thrust bearing 41, the rotary valve 40 will rotate smoothly, and reduce noise generation. The elastic force of the disc spring 42 and the length of the space for accommodating the rotary valve 40 can be adjusted by properly changing the thickness of the spacer 43. It is therefore possible to increase the tolerance in the selection of the size of the valve chamber 23. In addition, the provision of the thrust bearing 41 and disc spring 42 can properly maintain the pressure in the thrusting direction, which acts on the rotary shaft 8 from the rotary valve 40. Therefore, the reaction force to each piston which is generated during the compression stage can be securely received by the thrust bearing **11*a* in the front housing 2, thus improving the durability of that bearing 11*a***.

A few exemplary modifications to the second embodiment will now be described.

Figure 14:
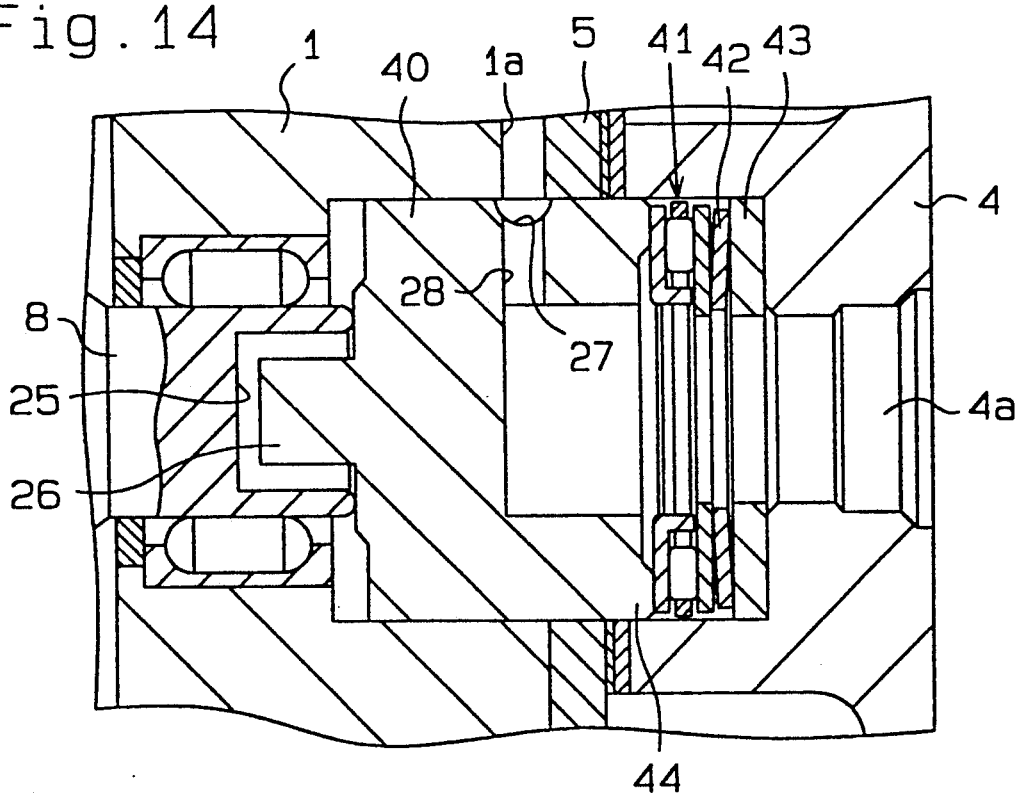
FIG. 14 is a partial cross sectional view showing a modification of the second embodiment.
Figure 15:
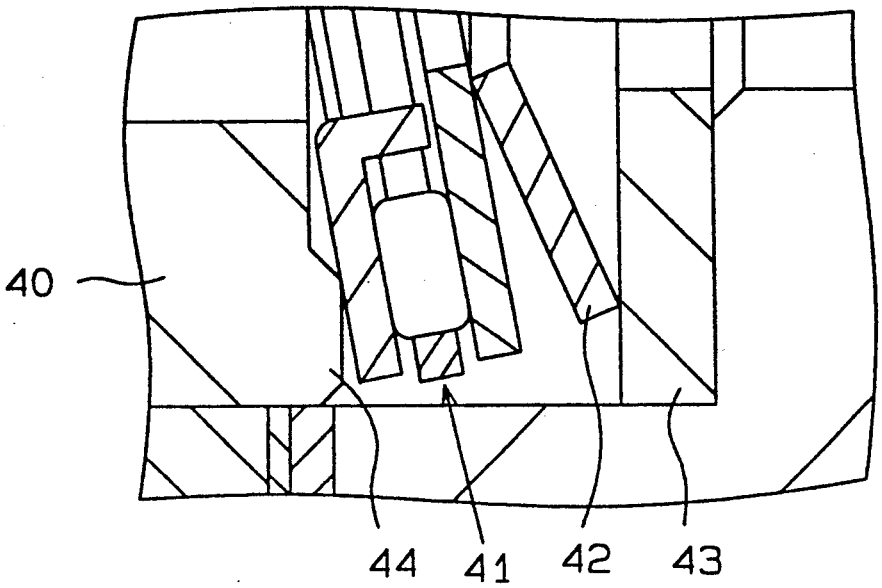
FIG. 15 is a partly enlarged cross sectional view illustrating the operational state of the modification in FIG. 14.

In a first modification shown in FIGS. 14 and 15, an annular rim 44 supports only the side of a thrust bearing 29 closer to the outer periphery thereof, and is integrally formed on the outer surface of the rear end of the rotary valve 40. The thrust bearing 29 is made of an elastically deformable material. The other structure is the same as that of the first embodiment.

In this first modification, at the assembling time, a disc spring having the desired elasticity and a spacer having the desired thickness, are selected among various disc springs 42 having different urging forces and spacers 43 having different thicknesses. When the elasticity of the selected disc spring 42 or the thickness of the selected spacer 43 is not the proper one, the outer peripheral portion of the thrust bearing 41 elastically deforms toward the rear of the compressor, as shown in FIG. 15. This can prevent the urging force acting on the thrust bearing 11*a* in the front housing 2 from becoming excessively large, thus allowing the rotary shaft 8 and rotary valve 40 to rotate smoothly.

Figure 16:
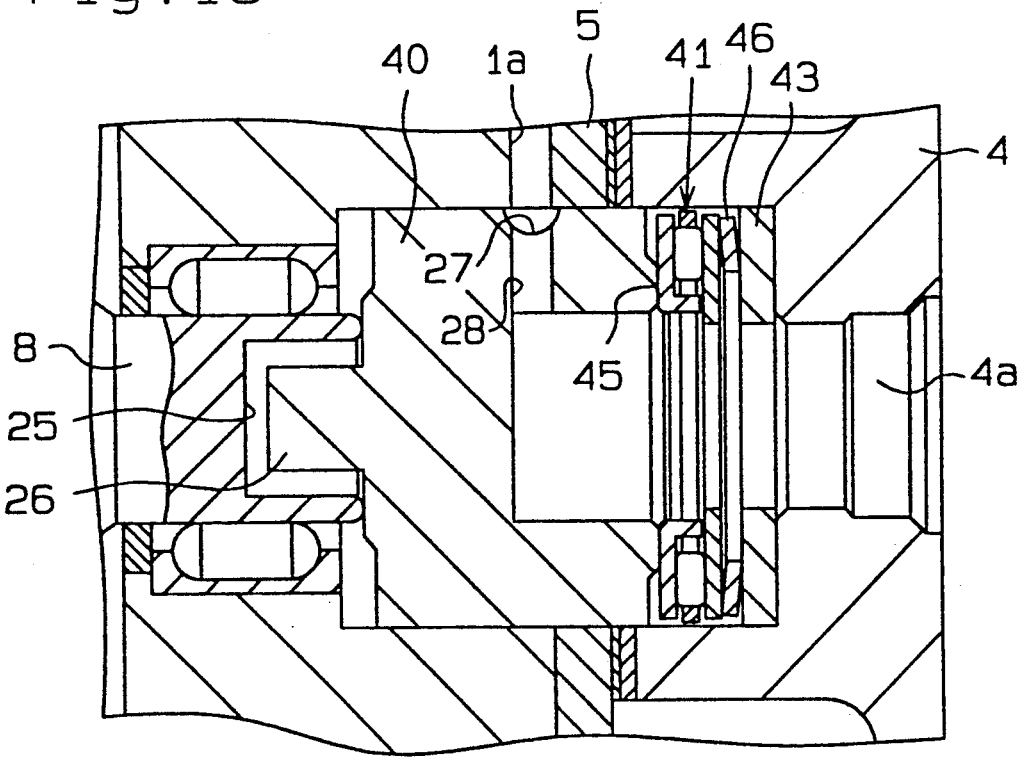
FIG. 16 is a partial cross sectional view showing another modification of the second embodiment.
Figure 17:
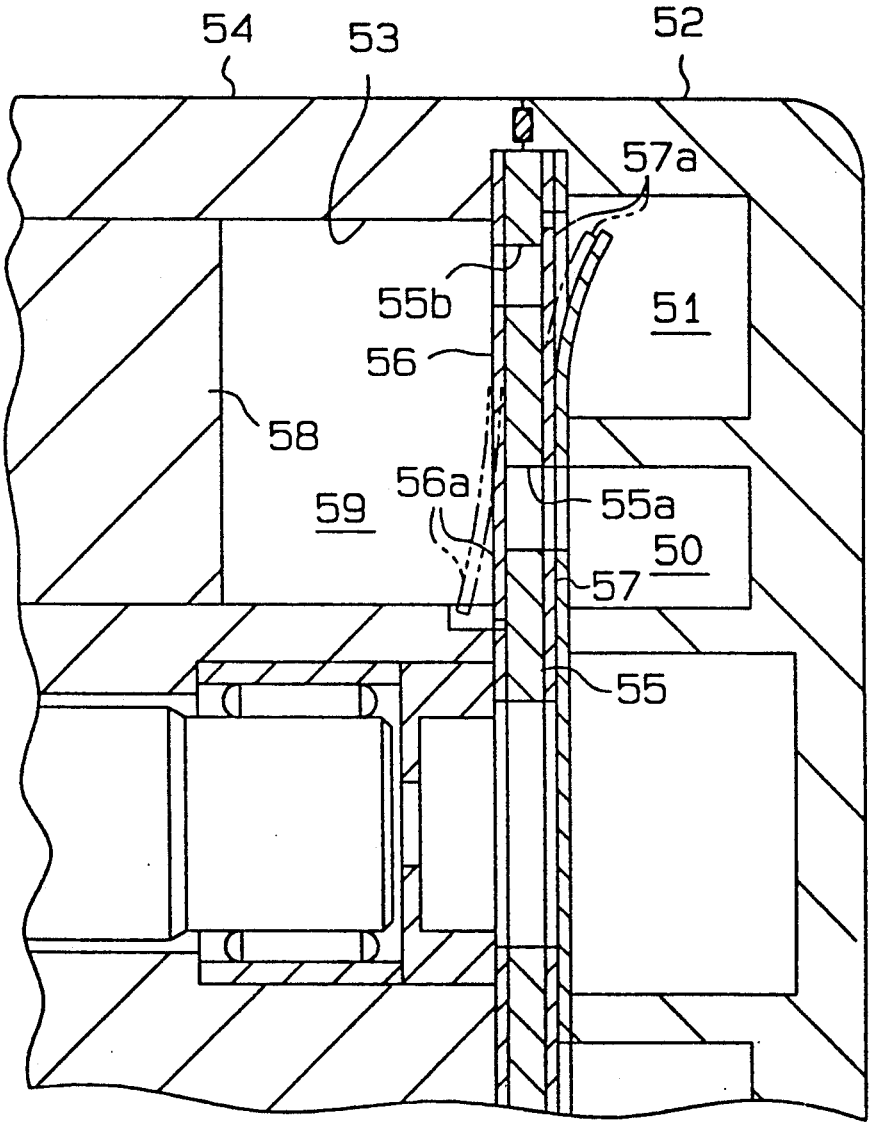
Fig. 17 Prior Art
FIG. 17 is a partial cross sectional view showing a conventional swash plate type compressor.

A second modification shown in FIG. 16 differs from the previous modification and the second embodiment in the position of the annular rim formed and the shape of the disc spring. An annular rim 45 is formed in the inner wall of the rear end of the rotary valve 40. A disc spring 46 is designed in such a way that its periphery presses the side of the thrust bearing 41 closer to the periphery thereof. This modification presents a similar performance and advantages to those of the first modification, except that the peripheral portion of the thrust bearing 41 elastically deforms toward the front of the compressor.

The present invention is not limited to the above-described embodiments, but it should be apparent to those skilled in the art that the present invention may be embodied in the following manners:

(1) The shapes of the connecting holes 25 and 32 and the cross-section of the connecting protrusions 26 and 31 may be changed to an arbitrary shape, such as a triangle, a pentagon or an ellipse.

(2) The rotary valve 24 or 40 is disposed in the passage that permits the suction chamber 4*a* to communicate with the working chambers 19*a* in the above-described embodiments. Alternatively, this rotary valve may be disposed in the passage that permits the discharge chamber 4*b* to communicate with the working chambers 19*a*. Further, the suction and discharge guide grooves and passages may be formed in a single rotary valve 24 or 40.

(3) The present invention may be applied to a swash plate type compressor having double-ended pistons.

What is claimed is:

1. A coolant gas guiding mechanism or use in a compressor equipped with a housing having a suction chamber and a discharge chamber, a cylinder block connected to the housing, a plurality of cylinder bores formed in the cylinder block, and a plurality of pistons in corresponding cylinder bores, such that rotation of a rotary shaft is converted to reciprocating motion of each piston by means of a swash plate, the mechanism comprising:

a valve chamber provided between said housing and said cylinder block to communicate with at least one of said suction chamber and discharge chamber;

a plurality of passages for allowing said valve chamber to be connected to said cylinder bores;

a rotary valve disposed within said valve chamber, said rotary valve including an outer peripheral surface that can close said passages in accordance with the rotation of the rotary valve in one of a suction stage and a compression stage of a coolant gas;

a guide groove provided in said outer peripheral surface, to permit communication between each of said cylinder bores and an associated one of said passages, in one of the suction stage and the compression stage of the coolant gas;

a gas passage provided in said rotary valve, said gas passage having one end connected to said guide groove and another end for connection to one of said suction chamber and discharge chamber;

connecting means for connecting said rotary valve to said rotary shaft with a clearance therebetween; and wherein said rotary valve is substantially aligned along a longitudinally extending line, and said connecting means connects one end of said rotary shaft and an adjacent end of said rotary valve.

2. The coolant gas guiding mechanism according to claim 1, wherein said rotary shaft and rotary valve are substantially co-axially aligned, and said connecting means connects one end of said rotary shaft and an adjacent end of said rotary valve.

3. The coolant gas guiding mechanism according to claim 2, wherein said connecting means comprises a protrusion provided on one of said connected ends, and a recess provided in the other end; and wherein, when said recess and said protrusion are engaged, a predetermined clearance exists between them.

4. The coolant gas guiding mechanism according to claim 3, wherein said clearance ranges between 0.2 mm and 2 mm.

5. The coolant gas guiding mechanism according to claim 1, wherein said guide groove has a length of about one half of the perimeter of said outer peripheral surface of said rotary valve.

6. The coolant gas guiding mechanism according to claim 1, wherein said passages are formed in said cylinder block.

7. The coolant gas guiding mechanism according to claim 1, wherein said valve chamber communicates with said suction chamber.

8. The coolant gas guiding mechanism according to claim 3, wherein said protrusion is provided eccentrically positioned relative to the axis of said rotary shaft.

9. The coolant gas guiding mechanism according to claim 1, wherein said connecting means comprises an elastically deformable coupling.

10. The coolant gas guiding mechanism according to claim 2, wherein said connecting means comprises a protrusion provided on one of said connected ends, and a recess provided in the other end; and wherein said protrusion is pressed into said recess to be coupled thereto by a key.

11. The coolant gas guiding mechanism according to claim 1, wherein said rotary valve is rotatably supported on an inner wall of said valve chamber, and wherein a thrust bearing is provided in said valve chamber for receiving a load acting on said rotary valve in a thrust direction.

12. The coolant gas guiding mechanism according to claim 11, wherein a spring is further provided in said valve chamber for pressing said thrust bearing toward said rotary valve.

13. The coolant gas guiding mechanism according to claim 12, wherein a spacer is further provided in said valve chamber to fill up a clearance between said inner wall of said valve chamber and said spring.

14. A coolant gas guiding mechanism for use in a compressor equipped with a housing having a suction chamber and a discharge chamber, a cylinder block connected to the housing, a plurality of cylinder bores formed in the cylinder block, and a plurality of pistons in corresponding cylinder bores, such that each piston reciprocates as a function of the rotation of a rotary shaft, the mechanism comprising:

a valve chamber provided between said housing and said cylinder block to communicate with at least one of said suction chamber and discharge chamber;

a plurality of passages for allowing said valve chamber to be connected to said cylinder bores;

a rotary valve disposed within said valve chamber, said rotary valve including an outer peripheral surface;

a guide groove provided in said outer peripheral surface, to permit communication between each of said cylinder bores and an associated one of said passages, in at least one of a suction stage and a compression stage of a coolant gas;

a gas passage provided in said rotary valve, said gas passage having one end connected to said guide groove and another end for connection to one of said suction chamber and discharge chamber;

connecting means for connecting said rotary valve to said rotary shaft, said rotary shaft and rotary valve being substantially co-axially aligned, and including two adjacent ends being connected by said connecting means, said connecting means comprising a protrusion provided on one of said adjacent ends and a recess provided in the other end, and wherein when said recess and said protrusion are engaged, a predetermined clearance exists between them.

15. A coolant gas guiding mechanism for use in a compressor equipped with a housing having a suction chamber and a discharge chamber, a cylinder block connected to the housing, a plurality of cylinder bores formed in the cylinder block, and a plurality of pistons in corresponding cylinder bores, such that each piston reciprocates as a function of the rotation of a rotary shaft, the mechanism comprising:

a valve chamber provided between said housing and said cylinder block to communicate with at least one of said suction chamber and discharge chamber;

a plurality of passages for allowing said valve chamber to be connected to said cylinder bores;

a rotary valve disposed within said valve chamber, and supported rotatably on an inner wall of said valve chamber, said rotary valve including an outer peripheral surface;

a guide groove provided in said outer peripheral surface, to permit communication between each of said cylinder bores and an associated one of said passages, in at least one of a suction stage and a compression stage of a coolant gas;

a gas passage provided in said rotary valve, said gas passage having one end connected to said guide groove and another end for connection to one of said suction chamber and discharge chamber;

connecting means for connecting said rotary valve to said rotary shaft, said rotary shaft and rotary valve being substantially co-axially aligned, and including two adjacent ends being connected by said connecting means, said connecting means comprising a protrusion provided on one of said adjacent ends and a recess provided in the other end, and wherein when said recess and said protrusion are engaged, a predetermined clearance exists between them;

a thrust bearing, provided in said valve chamber, for receiving a load acting on said rotary valve in a thrust direction;

a spring, provided in said valve chamber, for pressing said thrust bearing toward said rotary valve; and a spacer provided in said valve chamber to fill up a clearance between said inner wall of said valve chamber and said spring.

16. The coolant gas guiding mechanism according to claim 2, wherein said connecting means connects the rotary shaft and the rotary valve with a connection incorporating an amount of play such that rotation of the rotary shaft is transmitted to the rotary valve while permitting limited relative movement of the rotary valve with respect to the rotary shaft.

17. A coolant gas guiding mechanism for use in a compressor equipped with a housing having a suction chamber and a discharge chamber, a cylinder block connected to the housing, a plurality of cylinder bores formed in the cylinder block with each cylinder bore including a corresponding piston, a rotary shaft, and a swash plate interconnecting said rotary shaft with said pistons for causing said pistons to reciprocate with rotation of said shaft, the mechanism comprising:

a valve chamber provided between said housing and said cylinder block;

each of said cylinder bores having at least one associated passage for allowing said valve chamber to be connected to the respective cylinder bore;

a rotary valve disposed within said valve chamber, said rotary valve including an outer peripheral surface;

a guide groove provided in said outer peripheral surface for establishing communication between a plurality of said passages, during at least one of a suction stage and a compression stage of a coolant gas;

a gas passage provided in said rotary valve, said gas passage having one end connected to said guide groove and another end for connection to one of said suction chamber and discharge chamber; and connecting means for connecting said rotary valve to said rotary shaft for rotation therewith.

* * * * *

UNITED STATES PATENT AND TRADEMARK OFFICE

CERTIFICATE OF CORRECTION

PATENT NO. : 5,286,173

DATED : February 15, 1994

INVENTOR(S) : Takenaka et al

It is certified that error appears in the above-indentified patent and that said Letters Patent is hereby corrected as shown below:

Column 2, line 9, after "cylinder" insert --block. The valve chamber is connected to the cylinder--; line 46 "A-A" should read --9-9--.

Column 3, line 47, "equidistally" should read --equidistantly--.

Column 4, line 28, "fit" should read --fits--.

Column 7, line 46, after "mechanism", "or" should read --for--.

Signed and Sealed this

Twenty-seventh Day of September, 1994

*Attest:*

*Attesting Officer*

Bruce Lehman

BRUCE LEHMAN

*Commissioner of Patents and Trademarks*